United States Patent [19]

Caruso

[11] Patent Number: 4,506,606

[45] Date of Patent: Mar. 26, 1985

[54] FIRING MECHANISM

[76] Inventor: Anthony M. Caruso, 1620 Dallas St., Aurora, Colo. 80010

[21] Appl. No.: 461,400

[22] Filed: Jan. 27, 1983

[51] Int. Cl.[3] ..... F42B 27/00

[52] U.S. Cl. ..... 102/487

[58] Field of Search ..... 102/202.13, 204, 487, 102/482

[56] References Cited

U.S. PATENT DOCUMENTS

| | | | |
|---|---|---|---|
| 2,405,085 | 7/1946 | Zappone | 102/487 |
| 2,941,471 | 6/1960 | Sunden | 102/487 |
| 3,505,959 | 4/1970 | Lohnert et al. | 102/487 |
| 3,731,631 | 5/1973 | Berlin et al. | 102/487 |
| 3,998,164 | 12/1976 | Hadfield | 102/487 |

*Primary Examiner*—Charles T. Jordan
*Assistant Examiner*—Ted L. Parr
*Attorney, Agent, or Firm*—Charled E. Baxley

[57] ABSTRACT

A typical embodiment of the invention has a gasket pressed between the flange on a hand grenade fuze and the bore in the grenade's firing mechanism body that exposes the percussion cap to the striker in order to make the fuze waterproof and dirtproof. A threaded ferrule bears against the flange to press the gasket into this engagement. A portion of the ferrule extends over a length of the fuze housing to provide a heat shield that establishes the burning time of the fuze. In this way, striker impact is enhanced through a rigid, although readily removable fuze mounting; attenuated fuze effects caused by fully waterproofed fuze lengths are avoided; and fuze assembly is completed after the striker is "cocked" and secured by the safety handle and associated cotter pin.

1 Claim, 1 Drawing Figure

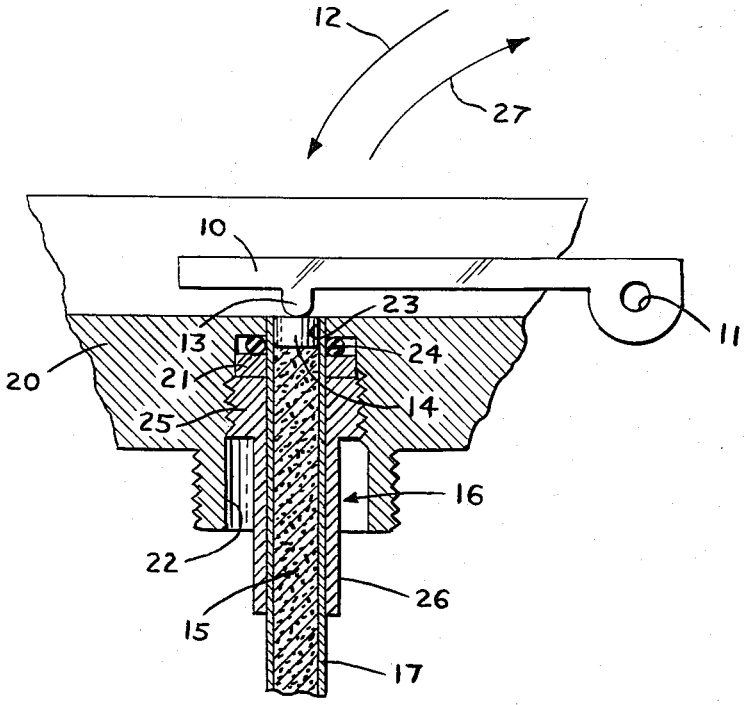
12
27
10
23
13
24
11
20
21
14
25
16
22
26
15
17

FIRING MECHANISM

BACKGROUND OF THE INVENTION

1. Field of the Invention

This invention relates to firing mechanisms for munitions and, more particularly, to a threaded ferrule and gasket combination for mounting a fuze and heat shield in the firing mechanism for a hand grenade, and the like.

2. Prior Art

An entirely satisfactory munition presents a number of difficult technical problems. The munition, for example, must be relatively inexpensive, as well as being easy and safe to manufacture. The munition, moreover, should enjoy reliable operation in spite of rough handling and exposure to extreme environmental conditions. Hand grenade firing mechanisms are a typical munition component that is subject to these foregoing basic requirements.

Ordinarily a hand grenade firing mechanism is threaded into the casing that contains the main explosive charge. A spring-loaded striker is held in a "cocked" position by means of a safety lever which, in turn, is secured to the body of the grenade through an extractable pin. If the pin is pulled from the safety lever, only the manual force pressing the grenade and the safety lever together in the palm of the hand keeps the striker in the "cocked" position. As the grenade is thrown, this manual force is removed and the biasing spring on the striker forces the striker to flip the safety lever off the grenade and slam the striker down on a percussion cap. The cap detonates to ignite the grenade's fuze. The fuze, after a predetermined period of burning, initiates the explosion of the main charger.

This basic mechanical combination is subject to a number of further conflicting requirements. A heat shield is provided, for example, between the fuze and the main charge to prevent a premature explosion. Frequently, this heat shield encloses the entire fuze in order to provide waterproofing for the fuze. This approach, however, has the unfortunate side effect of insulating the fuze from the main charge and thereby promoting misfires. If the fuze is not waterproofed, then water may enter the casing and impair detonator action by acting as a shock absorber.

Clearly there is a need to lodge the fuze securely within the grenade to obtain maximum impact effect from the striker. It is difficult to reconcile this need with a countervailing requirement for a fuze that can be removed from the grenade casing with relative ease for shipment to ammunition distribution points, and the like. Thus, if the fuze is loosely mounted within the casing to permit easy withdrawal, then the elasticity that is inherent in a loose mounting of this nature will attenuate striker impact and produce misfires and "duds".

Fuze insertion during grenade assembly introduces another major problem. In some grenades, the striker is held in a "cocked" condition by a blocking fixture as the fuze is inserted. The safety lever is mounted in place and the safety pin is then inserted into the safety lever to permit the striker blocking fixture to be removed. Unquestionably, this is a dangerous operation because an accidental striker release and subsequent grenade explosion always is a possibility.

Accordingly, there is a need for an improved fuze assembly that overcomes these difficulties that have characterized the prior art and reconciles the need for a waterproof, removable fuze with a heat shield of adequate length, in an assembly that enables the firing mechanism to be assembled more safely.

DESCRIPTION OF THE INVENTION

These and other problems that have characterized the prior art are overcome, to a large extent, through the practice of the invention. Illustratively, a fuze is provided with an annular flange that presses a gasket into contact with a firing mechanism body in watertight engagement. An externally threaded ferrule mates with threading in a recess in the firing mechanism body and bears against the opposite transverse surface of the flange on the fuze in order to provide not only the necessary gasket compression, but also to provide a heat shield of sufficient length to establish the predetermined fuze time delay while exposing the balance of the fuze train to the main explosive charge within the grenade. The threaded ferrule, moreover, permits the fuze to be inserted into or removed from a rigid engagement within the firing mechanism body after the safety handle and pin combination have safely secured the striker in "cocked" condition. In this manner, the striker impact on firing is not attenuated through the elasticity that is inherent in the loose fuze mountings that usually are required of removable fuze-type hand grenade firing mechanisms.

Thus, the invention provides a relatively inexpensive, watertight, fuze assembly that is easy to assemble and disassemble and that does not attenuate the striker impact, nor does it have an encapsulating heat shield that suppresses the effect of an ignited fuze. These and other salient characteristics of the invention are to be understood in more complete detail through a study of the following description of a preferred embodiment taken with the drawing. The scope of the invention, however, is limited only through the claims appended hereto.

BRIEF DESCRIPTION OF THE DRAWING

The sole FIGURE of the drawing is a front elevation in full section of a portion of a hand grenade firing mechanism that embodies principles of the invention.

DETAILED DESCRIPTION OF A PREFERRED EMBODIMENT

As shown in the drawing, a hand grenade has a flat metal striker 10. The striker 10 is provided with a hinge 11 to permit a biasing spring (not shown in the drawing) to pivot the striker in the direction of arrow 12 when the striker is released to fire the grenade. Pivotal movement of the striker 10 in the direction of the arrow 12 enables a protruding percussion pin 13 to impact a sensitive percussion cap 14 at one end of a fuze train 15 in a fuze 16.

As illustrated, the fuze 16 has a long, hollow, thin cylindrical housing 17 that encases the fuze train 15. The percussion cap 14 closes one end of the housing 17 to permit the cap to be flush with the surface of firing mechanism body 20 and exposed to the protruding end of the percussion pin 13.

In accordance with a feature of the invention, an annular flange 21 protrudes from the outer surface of the fuze housing 17 in a direction that is transverse to the longitudinal axis of the housing. The flange 21, moreover, is spaced a short distance from the end of the housing 17 that receives the percussion cap 14.

The fuze 16 is received in a threaded recess 22 formed in the side of the firing mechanism body 20 that is opposite to and in alignment with the striker 10 and the percussion pin 13. A bore 23 is formed at the end of the threaded recess 22 to receive the end of the fuze housing 17 and to expose the percussion cap 14 to the pin 13. A waterproofing gasket or "O" ring 24 is interposed between the annular flange 21 and the portion of the firing mechanism body 20 in which the bore 23 is formed.

An externally threaded ferrule 25 is received in the recess 22 and bears against the annular surface of the flange 21 that is opposite to the surface that sustains the gasket 24. A heat shield portion 26 of the ferrule 25 extends out of the recess 22 and encloses a sufficiently long portion of the fuze housing 17 to establish a predetermined fuze burning time between the impact of the percussion pin 13 on the cap 14 and the explosion of the main charge (not shown) in the grenade. The balance of the fuze 16 protrudes beyond the end of the heat shield 26 to enjoy an unimpeded and direct influence upon the main explosive charge.

In operation, the striker is pressed in the direction of arrow 27 against the force of the biasing spring (not shown) to a "cocked" position. A safety handle (also not shown) is placed over the "cocked" striker and locked in this position by means of a cotter pin (also not shown). Thus secured in the foregoing manner, the gasket 24 is placed on the surface of the annular flange 21 adjacent to the percussion cap 14 and the fuze 16 is seated in the recess 22 and the bore 23 to permit the cap to be flush with the surface of the firing mechanism body 20.

The treaded end of the ferrule 25 is slipped over the end of the fuze housing 17 that protrudes from the firing mechanism body 20 to enable the external threading on the ferrule to engage with the threading in the recess 22. The ferrule 25 in this way establishes a rigid, inelastic mounting for the fuze 16 and bears against the flange 21 with sufficient force to press the gasket 24 on the opposite side of the flange into a watertight and debris tight relationship with the fuze housing 17 and the bore 23.

Upon pulling the cotter pin and releasing the safety handle (both not shown), the biasing spring (also not shown) snaps the striker 10 in the direction of the arrow 12 to cause the percussion pin 13 to strike the cap 14 with sufficient force to cause the explosive within the cap to detonate. This detonation ignites the fuze train 15, causing the train to burn progressively toward the end of the heat shield 26. The heat shield 26 protects the main explosive charge (not shown) within the grenade from explosion for the time that it takes the flame front in the fuze train 15 to burn past the end of the heat shield 26. Once the flame front in the fuze train 15 burns past the heat shield 26, the burning fuze enters intimate contact with the main explosive charge and thereupon initiates main charge bursting without interference from the insulating effect of waterproofing that has characterized the prior art.

To disassemble the firing mechanism, the striker 10 is held in "cocked" position by means of the safety handle and the associated cotter pin. The ferrule 25 is unthreaded from the recess 22 and the fuze 16 with the associated gasket 24 is extracted from the bore 23 and the recess 22.

Naturally, the ferrule can be an integral part of the fuze 16, as well as the flange 21.

Clearly the invention provides a simple and inexpensive apparatus that permits the firing mechanism of a hand grenade to be "cocked" and secured before the fuze is inserted. The fuze is rigidly mounted in the body of the firing mechanism to achieve maximum effect of the impact of the striker on the percussion cap, while nevertheless being capable of removal, as required. The gasket also provided adequate waterproofing and thereby permits the heat shield to mark only a predetermined length of the fuze train, rather than to enclose the entire fuze train, as in the prior art, in order to serve the unsatisfactory double function of heat shield and waterproofing.

I claim:

1. A firing mechanism for a grenade comprising, a firing mechanism body having a threaded recess formed therein within said body and a bore through said body formed at one end of said threaded recess, a hollow cylindrical fuze housing, a percussion cap lodged in one end of said fuze housing and mounted in said bore flush with said firing mechanism body, a flange protruding from said housing in a plane generally perpendicular to the longitudinal axis of said cylindrical housing spaced from said percussion cap, a gasket interposed between said flange and said firing mechanism body and adjacent to said bore in order to form a watertight seal therewith, and a threaded ferrule having a heat shield portion extending from said recess along a length of said fuze housing to establish a predetermined fuze burning time, said threaded ferrule being in engagement with said recess threading to bear against said flange and thereby to press said gasket into a water-tight relationship with said bore.

* * * * *